United States Patent [19]

Berryman et al.

[11] Patent Number: 4,989,987

[45] Date of Patent: Feb. 5, 1991

[54] SLURRY MIXING APPARATUS

[75] Inventors: Leslie N. Berryman; Herbert J. Horinek; Max L. Phillippi; David A. Prucha; Vincent G. Reidenbach; Stanley V. Stephenson, all of Duncan, Okla.

[73] Assignee: Halliburton Company, Duncan, Okla.

[21] Appl. No.: 452,296

[22] Filed: Dec. 18, 1989

Related U.S. Application Data

[62] Division of Ser. No. 340,110, Apr. 18, 1989.

[51] Int. Cl.[5] ..... B28C 5/08; B01F 5/12

[52] U.S. Cl. ..... 366/65; 366/263

[58] Field of Search ..... 366/65, 131, 136, 137, 366/159, 176, 262, 263, 264, 265, 272; 417/36

[56] References Cited

U.S. PATENT DOCUMENTS

| | | | |
|---|---|---|---|
| 3,461,803 | 8/1969 | Stothoff | 417/36 |
| 4,415,267 | 11/1983 | Hill | 366/65 |
| 4,453,829 | 6/1984 | Althouse | 366/262 |
| 4,499,562 | 2/1985 | Campolini | 366/264 |
| 4,834,542 | 5/1989 | Sherwood | 366/65 |

OTHER PUBLICATIONS

Exhibit A—several pages from a brochure for Galigher double suction vertical sump pumps, 9/1987.

Exhibit B—Booklet entitled "Liquid Agitation", prepared by Chemineer.Kenics, Houston, Texas, 12/75.

*Primary Examiner*—Robert W. Jenkins

*Attorney, Agent, or Firm*—James R. Duzan; L. Wayne Beavers

[57] ABSTRACT

A mixing apparatus is provided for mixing slurries, particularly high density, high viscosity fracturing fluid slurries containing a large proportion of proppant material. A mixing tub has a generally round horizontal cross-sectional shape. A relatively large, low-speed rotating agitator is utilized to mix the slurry. The design of the agitator is such that a radially inwardly rolling toroidal shaped slurry flow zone is created adjacent the upper surface of the slurry within the tub. A stream of clean fracturing fluid is introduced into the tub near the center of the toroidal shaped flow zone. Dry proppant material is introduced into the tube and carried by the radially inwardly rolling flow into contact with the clean fracturing fluid. Foraminous baffles, preferably constructed from expanded metal sheets, are radially oriented within the tub to reduce rotational motion of the slurry within the tub without causing dropout of proppant from the slurry. A double suction vertical sump pump is utilized to pump the slurry from the tub.

4 Claims, 7 Drawing Sheets

SLURRY MIXING APPARATUS

This application is a division of application Ser. No. 07/340,110, filed Apr. 18, 1989.

BACKGROUND OF THE INVENTION

1. Field of the Invention

The present invention relates generally to apparatus and methods for mixing fluids, and more particularly, but not by way of limitation, to the mixing of high density proppant laden gelled slurries for use in oil well fracturing.

2. Description of the Prior Art

One common technique for the stimulation of oil or gas wells is the fracturing of the well by pumping of fluids under high pressure into the well so as to fracture the formation. The production of hydrocarbons from the well is facilitated by these fractures which provide flow channels for the hydrocarbons to reach the well bore.

The fluids utilized for these fracturing treatments often contain solid materials generally referred to as propants. The most commonly used proppant is sand, although a number of other materials can be used. The proppant is mixed with the fracturing fluid to form a slurry which is pumped into the well under pressure. When the fractures are formed in the formation, the slurry moves into the fractures. Subsequently, upon releasing the fracturing pressure, the proppant material remains in the fracture to prop the fracture open.

A typical slurry mixing apparatus such as that presently in use by Halliburton Company, the assignee of the present invention, includes a rectangular shaped tub having dimensions on the order of six feet long by four feet wide by three feet deep. In the bottom of the tub, lying parallel to the length of the tub, are two augers which keep the slurry in motion near the bottom of the tub and minimize the buildup of sand in the bottom of the tub. Sometimes, rotating agitators having blades with a diameter on the order of twelve to fifteen inches are provided near the surface of the slurry. Fluid inlet to these blender tubs may be either near the bottom, through the side, or into the top of the tub. Sand is added by dumping it into the top of the tub.

Slurry mixing is of primary importance during a fracturing job. The sand must be mixed with the fracturing fluid which often is a high viscosity gelled fluid. The resulting slurry is a high viscosity, non-Newtonian fluid which is very sensitive to shearing and can be difficult to thoroughly mix. The viscosity of the fluid depends upon the motion of the fluid and thus the viscosity of the slurry is to a significant extent dependent upon the manner in which the slurry is mixed. Most oil field service companies have few problems with present technology when mixing low sand concentration slurries, i.e., ten pounds per gallon or less sand concentration. Problems, however, start to arise when the sand concentrations exceed ten pounds per gallon. Sometimes very high sand concentrations are desired up to approximately twenty pounds per gallon. The problems encountered when mixing these very high density slurries include air locking of centrifugal pumps, poor surface turbulence which leads to slugging of high pressure pumps and non-uniform slurry density, poor wetting of the new sand due to the problems of getting clean fluid and sand together without excessive agitation, the stacking of dry sand on the sides of the slurry tub, sealing of agitators to prevent fluid loss and the lack of available suction head at the centrifugal pumps.

There is a need for a mixing system particularly adapted for the effective mixing of high density sand slurries for well fracturing purposes.

SUMMARY OF THE INVENTION

The present invention provides an apparatus and method particularly designed for the mixing of these high density, high viscosity, non-Newtonian fracturing gel slurries. The mixing system of the present invention includes a number of novel aspects, all of which work together to provide a system which is very effective in the mixing of these slurries.

The system includes a mixing tub and agitator assembly which initially mix the slurry, and a unique sump pump arrangement which very effectively handles the slurry produced in the mixing tub while at the same time further enhancing the slurry by aiding in the removal of entrained air during the pumping operation.

The slurry is mixed in a generally round mixing tub with a relatively low speed, large diameter, rotating blade-type agitator. The agitator generates a radially inwardly rolling generally toroidal shaped upper slurry flow zone adjacent an upper surface of the slurry in the tub.

Clean fracturing fluid, typically a gelled fluid, is introduced downwardly into the center of the toroidal shaped upper slurry flow zone. Dry proppant material is also introduced into the flow zone and is moved radially inward into contact with the clean fracturing fluid thereby wetting the dry proppant with the clean fracturing fluid to form the slurry in the tub.

A foraminous baffle means is mounted within the tub for reducing rotational motion of the slurry within the tub about a vertical central axis of the agitator without causing substantial dropout of the solid material from the slurry.

In combination with this mixing system, a preferred pump is utilized which has a centrifugal impeller rotating about a generally vertical axis within a pump housing, and has upper and lower suction inlets defined in the housing on axially opposite sides of the impeller. The tub has upper and lower fluid outlets. A lower suction conduit connects the lower fluid outlet of the tub with the lower suction inlet of the pump. A standpipe has a lower end connected to the upper suction inlet of the pump and has a fluid inlet communicated with the upper fluid outlet of the tub. Thus, the pump draws slurry through both its upper and lower suction inlets. The pump is adjusted so that the flow is primarily from the lower fluid outlet of the tub through the lower suction inlet of the pump. Due to the vertical orientation of the axis of rotation of the pump, entrained air in the slurry can escape through the eye of the pump up through the standpipe connected to the upper suction inlet.

This system is capable of effectively mixing sand and gel slurries for well fracturing having densities of in excess of twenty pounds per gallon solids-to-liquid ratio.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
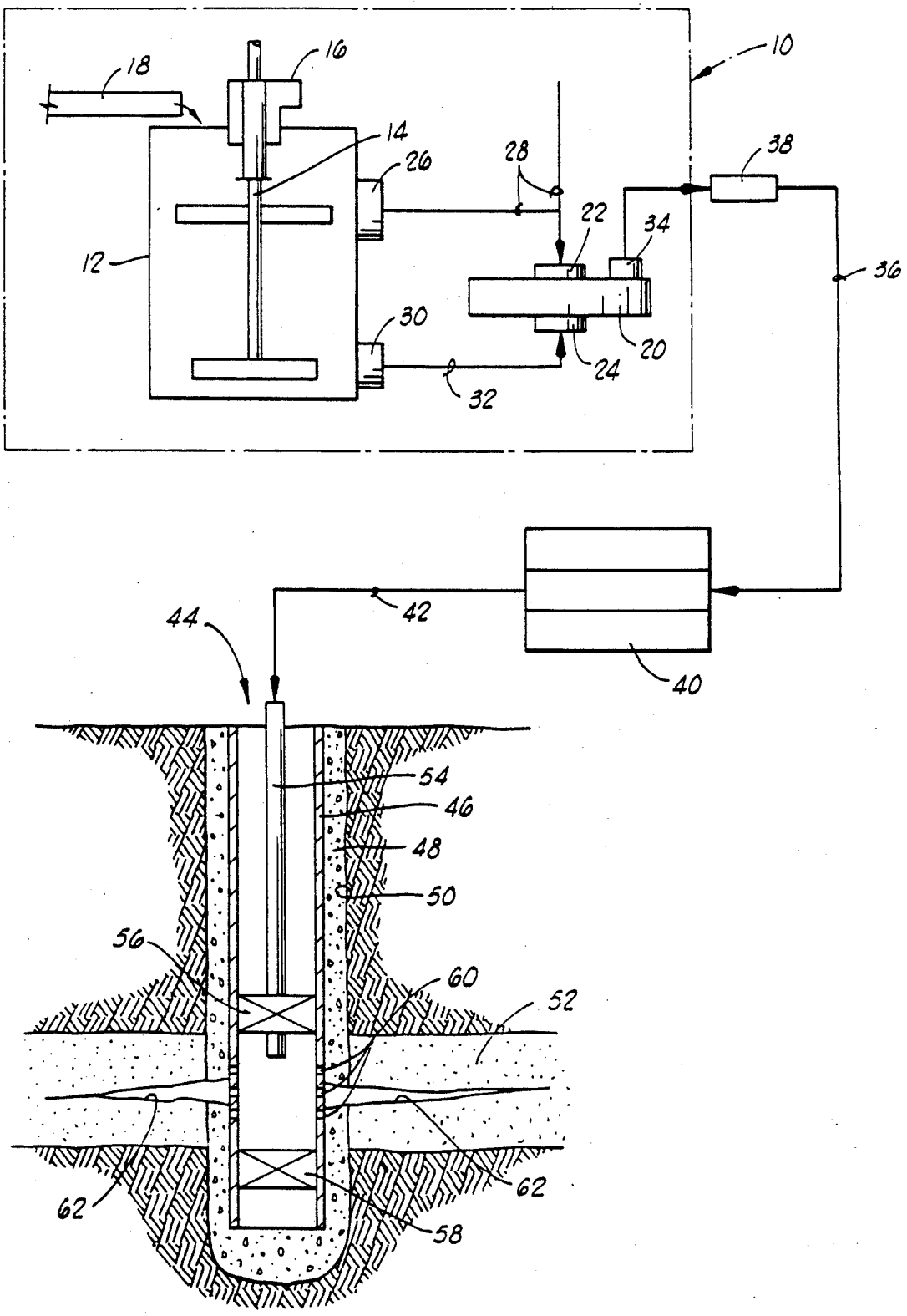
FIG. 1 is a schematic illustration of the slurry mixing apparatus of the present invention and an oil well, along with associated equipment for pumping the slurry into the well to fracture a subsurface formation of the well.

Referring now to the drawings, and particularly to FIG. 1, the mixing apparatus of the present invention is there schematically illustrated along with an oil well and associated high pressure pumping equipment for pumping the slurry into the well to fracture the well. The mixing apparatus is contained within a phantom line box and is generally designated by the numeral 10.

The major components of the mixing apparatus 10 include a mixing tub 12, a rotating agitator means 14, a clean fluid inlet means 16, and a dry proppant supply means 18. Also included as part of apparatus 10 is a double suction vertical sump pump 20 having upper and lower suction inlets 22 and 24. The upper suction inlet 22 is connected to an upper fluid outlet 26 of tub 12 by a standpipe 28. The lower suction inlet 24 is connected to a lower tub fluid outlet 30 by a lower suction conduit 32. Pump 20 has a discharge outlet 34.

The pump 20 takes slurry from the tub 12 and pumps it out the discharge outlet 34 into a discharge line 36. A radioactive densometer 38 is placed in discharge line 36 for measuring the density of the slurry. The discharge line 36 leads to a high pressure pump 40 which boosts the pressure of the slurry downstream of the sump pump 20 and moves the high pressure slurry into a slurry injection line 42 which directs it to the well generally designated by the numeral 44.

The well 44 is schematically illustrated as including a well casing 46 set in concrete 48 within a well bore 50. The well bore 50 intersects a subsurface formation 52 from which hydrocarbons are to be produced.

The slurry injection line 42 is connected to a tubing string 54 which extends down into the casing 46 to a point adjacent the subsurface formation 52. A packer 56 seals between the tubing string 54 and the casing 46. At a lower elevation a second packer or bridge plug 58 also seals the casing.

Between the packers 56 and 58 a series of perforations 60 have been formed in the casing 46.

When the high pressure slurry is injected down through the tubing 54 it moves through the perforations 60 into the formation 52 where it causes the rock of the formation 52 to split apart forming fractures 62.

Figure 2:
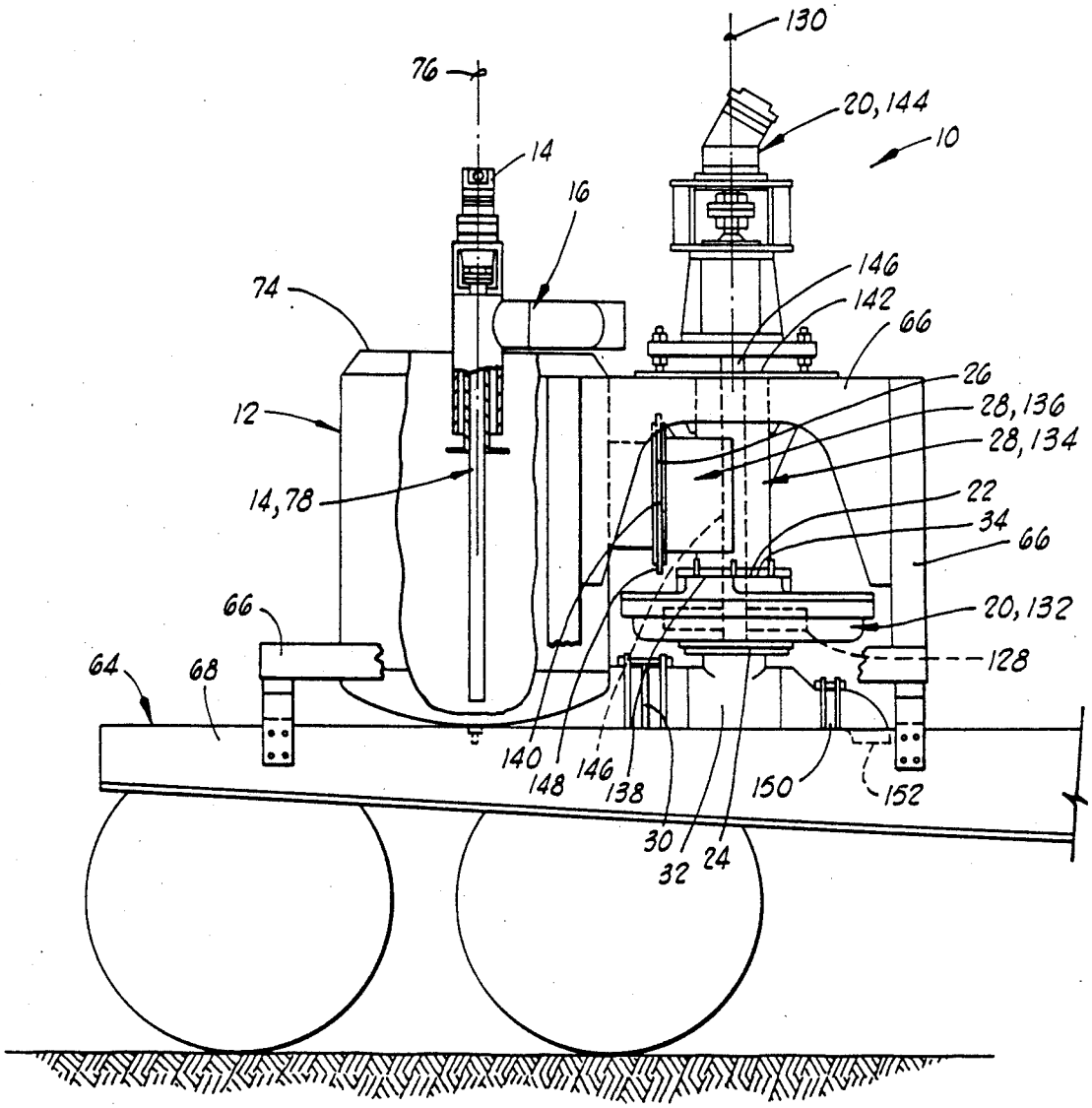
FIG. 2 is an elevation, partly cutaway view of the mixing tub, agitator, and sump pump with associated plumbing in place upon a wheeled vehicle. The agitator blades and the baffles are not shown in FIG. 2.

In FIG. 2, the mixing apparatus 10 is shown in place upon a wheeled vehicle 64. The agitator blades and baffles are not in place in the view of FIG. 2. The various components of mixing apparatus 10 previously mentioned are all mounted upon a support structure 66 which itself is attached to the frame 68 of vehicle 64.

Figure 3:
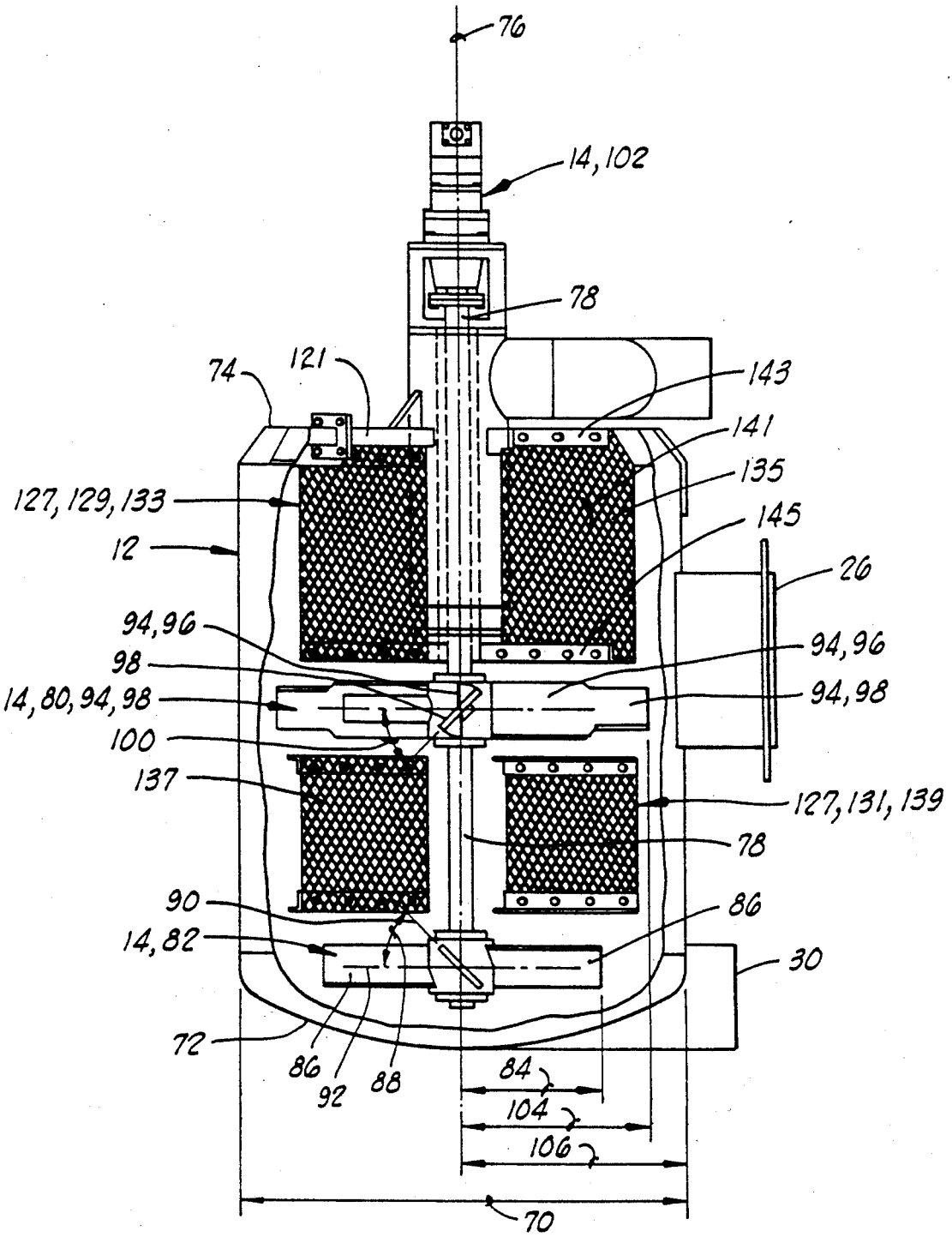
FIG. 3 is an enlarged elevation, partially cutaway view of the mixing tub with the agitator and baffles in place therein.
Figure 5:
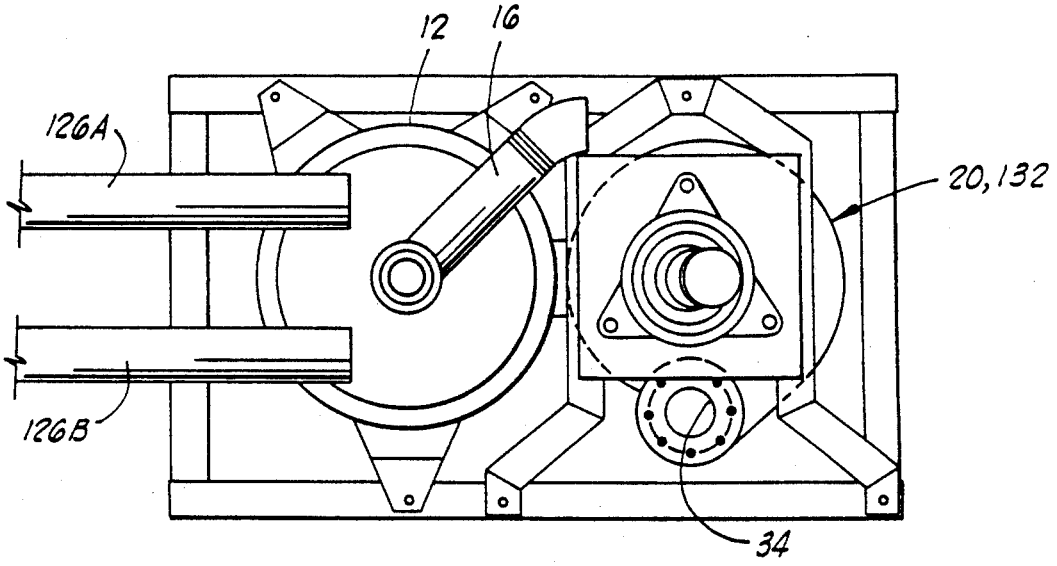
FIG. 5 is a plan view of the mixing apparatus and pump of FIG. 2.

The mixing tub 12 has a generally round, substantially circular, horizontal cross-sectional shape, as best seen in FIG. 5, defining a tub diameter 70 (see FIG. 3). The tub 12 has a closed bottom 72 and a generally open top 74.

The rotating agitator 14 provides a means for mixing the slurry in the tub 12. The agitator assembly 14 extends downward into the tub and is oriented to rotate about a generally vertical axis 76.

The agitator assembly 14 includes a drive shaft 78 located within the tub 12 and defining the vertical axis 76 about which the drive shaft 78 rotates.

Upper and lower agitator means 80 and 82 (see FIG. 3) are attached to the shaft 78. The lower agitator means 82 provides a means for moving the slurry generally downward through a radially inner cross-sectional area defined within a first radius 84 swept by the lower agitator means 82.

Figure 4:
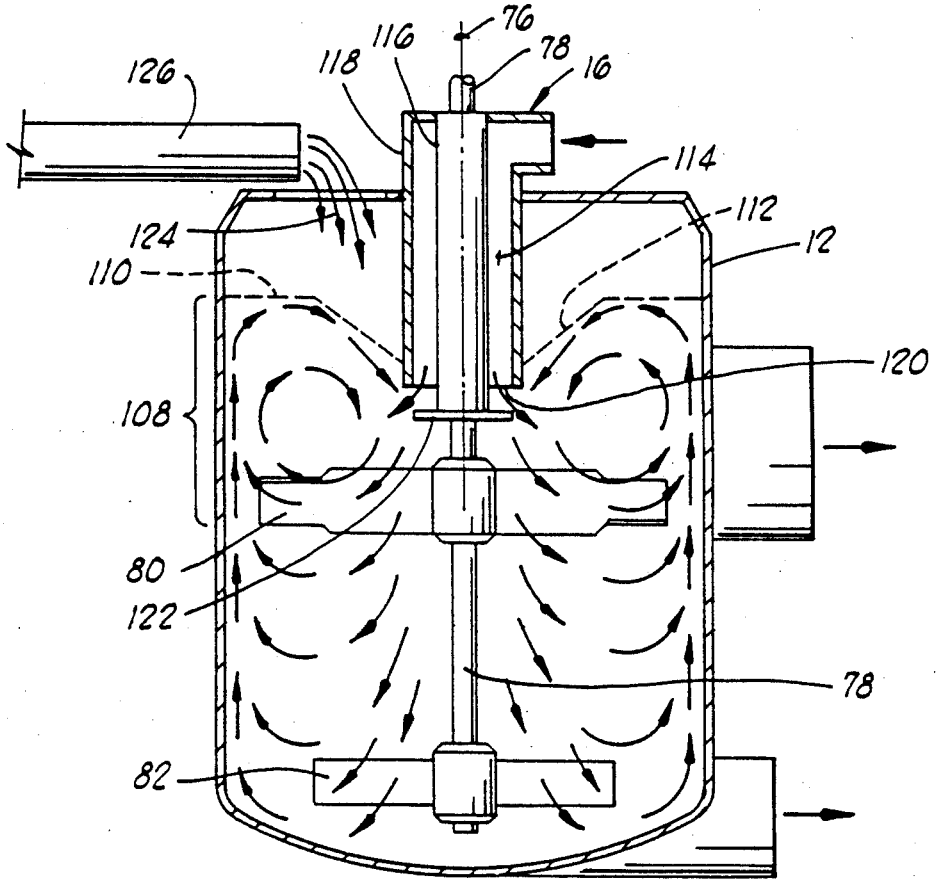
FIG. 4 is a schematic elevation sectioned view of the mixing tub and agitator means of FIG. 3, showing in a schematic fashion the flow pattern set up within the slurry in the mixing tub by the agitator.

The upper agitator means 80 provides a means for moving slurry within the first radius 84 generally radially outward as the slurry is moved generally downward by the lower agitator means 82, and for moving the slurry outside the first radius 84 generally upward. This flow pattern is best illustrated in FIG. 4.

The lower agitator means 82 includes four lower blades 86 spaced at angles of 90° about shaft 78. The blades 86 extend radially outward from the axis 76 a distance equal to the first radius 84. The lower blades 86 are substantially flat blades having a substantial positive pitch 88.

The drive shaft 78 rotates clockwise as viewed from above in FIG. 3. The pitch 88 of the blades 86 is defined as the forward angle between a plane 90 of blade 86 and a plane 92 of rotation of the lower agitator means 82.

The pitch 88 is defined for purposes of this disclosure as being positive when it lies above the plane of rotation 92. In the embodiment illustrated, the pitch 88 is equal to 45°. It will be apparent that when the drive shaft 78 is rotated clockwise as viewed from above, the positive pitch 88 of blades 86 will cause slurry to be pulled generally axially downward through the rotating blades 86.

The upper agitator means 80 includes four upper blades 94 spaced at angles of 90° about the shaft 78. Each of the upper blades 94 includes a radially inner portion 96 and a radially outer portion 98. The radially inner portion 96 is substantially flat and lies substantially in a vertical plane. The radially outer portion 98 has a substantial negative pitch 100. The negative pitch 100 in the embodiment illustrated is approximately equal to 45°.

The radially inner portions 96 of upper blades 94 extend radially outward from axis 76 a distance substantially equal to the first radius 84. The radially outer portions 98 extend beyond radius 84.

Slurry within the first radius 84 which is impacted by the radially inner portion 96 of upper blades 94 will be generally moved in a radially outward direction thereby. Slurry outside the first radius 84 which is impacted by the radially outer portions 98 of upper blades 94 will be moved in a generally upward direction thereby.

The relative dimensions of the upper and lower agitator means 80 and 82 and the tub 12 are important. It is desirable to maintain a relatively constant velocity of the slurry within the tub 12, because the slurry again is typically a relatively high density, high viscosity, non-Newtonian fluid, the viscosity of which is very sensitive to shear rates and thus to the velocity of the slurry within the tub. By maintaining a relatively constant velocity of the slurry within the tub, a relatively uniform viscosity is the slurry within the tub, a relatively uniform viscosity is maintained for the slurry throughout the tub. Also, in order to maintain flow patterns substantially like that shown in FIG. 4, it is preferable that the tank diameter 70 be approximately equal to the fluid depth 110 within the tub 12.

Below the upper agitator means 80, the flow of the slurry is generally downward within the first radius 84, and is generally upward outside the first radius 84. The downward velocity of slurry within the first radius 84 can generally be maintained substantially equal to the upward velocity of slurry outside the first radius 84 by choosing the radius 84 so that a circular cross-sectional area defined within the first radius 84 is substantially equal to an annular horizontal cross-sectional area outside the first radius 84. This means that first radius 84 should approach 0.707 times tub radius 106. When the apparatus 10 is operating in a steady state fashion, the downward flow within tub 12 will be equal to the upward flow within tub 12. The specified relationship of blade to tub dimensions will insure that an average downward flow velocity of the slurry within the cross-sectional area defined within first radius 84 is substantially equal to the average upward flow velocity of the slurry within the generally annular cross-sectional area outside of first radius 84.

More generally speaking, it can be said that it is desirable that the upper and lower agitator means 80 and 82 be slow speed large rotating agitators, relative to the dimensions of the tub 12. Certainly, a radial length 104 of upper blades 94 should be substantially greater than one-half the radius 106 of tub 12.

The agitator assembly 14 includes a drive means 102, which as seen in FIG. 2 is mounted on top of fluid inlet means 16. The drive means 102 provides a means for rotating the shaft 78 at relatively low speeds in a range of from about 1 to about 160 rpm. A typical rotational speed for drive means 102 is 100 rpm. The agitation speed is varied based upon proppant concentration and downhole flow rate.

Figure 8:
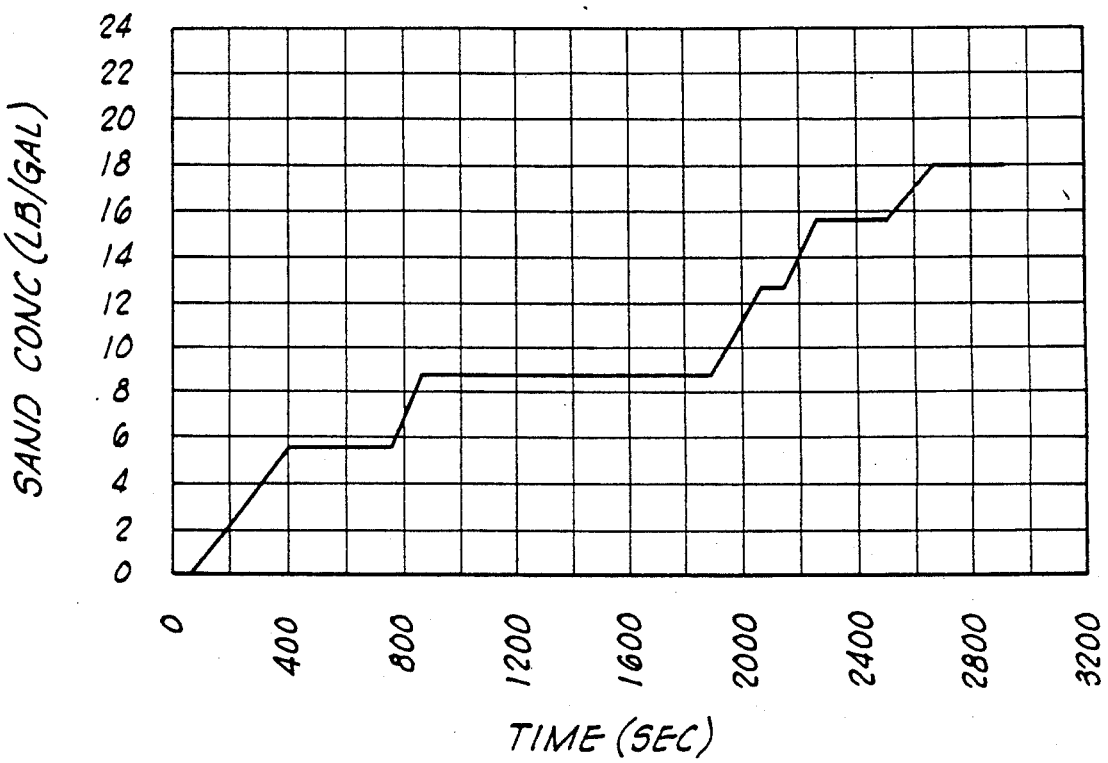

As best seen in the schematic illustration of FIG. 4, the construction of the upper agitator means 80 creates a radially inwardly rolling, generally toroidal shaped upper slurry flow zone 108 adjacent an upper surface 110 of the slurry in the tub 12. This results from the design of the radially inner blade portions 96 which cause generally radially outward motion of the slurry, and the radially outer blade portions 98 which cause a generally upward motion of the slurry. The toroidal shaped flow zone 108 has a center generally coaxial with the axis 76. As is illustrated in FIG. 8, the upper surface 110 of the slurry dips inward as indicated at 112 where it approaches the central axis 76.

The slurry within the toroidal flow zone 108, when viewed from above, is moving generally radially inward, and thus it can be described as radially inwardly rolling. The slurry within the zone 108, and particularly near the surface 110 will be in a relatively turbulent state, thus aiding in the mixing of the slurry.

Although not illustrated, it is of course necessary to provide a means for controlling the slurry level 110 within the tub 12. One preferred manner of accomplishing this is to utilize a pressure transducer located in the bottom of tub 12 to measure the hydraulic head. A signal from the pressure transducer feeds back to a microprocessor control system which in turn controls the flow rate of proppant and clean fracturing fluid into the tub 12.

The level of the slurry within the tub 12 relative to the placement of the upper agitator means 80 is important. The upper level 110 of the slurry should be a sufficient distance above the upper agitator means 80 to allow the radially inwardly rolling toroidal flow pattern 108 to develop. The level should not be significantly higher, however, than is necessary to allow that flow pattern to develop. If it is, then the radial velocities of fluid near the surface 110 will be reduced thus reducing the turbulence, which is undesirable.

The clean fluid inlet means 16 provides a means for directing a stream of clean fracturing fluid downward into the tub 12 proximate or near the vertical axis 76. The fluid inlet means 16 includes an annular flow passage 114 defined between concentric inner and outer cylindrical sleeves 116 and 118. An annular open lower end 120 is defined at the lower end of outer sleeve 118. The stream of clean fracturing fluid exits the annular opening 120 in an annular stream.

The fluid inlet means is supported from tub 12 by a plurality of support arms such as 121 seen in FIG. 3. The support arms 121 are not shown in FIGS. 2 or 5.

An annular deflector means 122 is attached to the inner sleeve 116 and is spaced below the open lower end 120 for deflecting the annular stream of fluid in a generally radially outward direction.

The rotating shaft 78 extends downward through the inner sleeve 116. The upper rotating agitator means 80 is located below the inlet means 16 and particularly the annular deflector means 122 thereof.

Thus, the clean fracturing fluid is introduced generally downwardly into the center of the toroidal shaped upper slurry flow zone 118 by means of the fluid inlet means 16. The clean fracturing fluid is typically a gelled aqueous liquid, but may also comprise other well known fracturing fluids. When the fracturing fluid is referred to as clean, this merely indicates that the fluid has not yet been mixed with any substantial amount of proppant material.

Dry proppant 124, typically sand, is introduced into the toroidal shaped flow zone 108 typically by conveying the same with a sand screw 126 which allows the proppant 124 to drop onto the top surface 110 of the slurry as near as is practical to the central axis 76. AS best seen in FIG. 5, there typically will be two such sand screws 126A and 126B.

When the proppant 124 falls onto the upper surface 110 of the slurry, it is moved radially inward by the radially inward rolling motion of the toroidal shaped flow zone 108 into the center of the toroidal shaped slurry flow zone 108 and thereby into contact with the clean fracturing fluid which is entering the center of the flow zone from the inlet means 16. Thus this dry proppant which is being introduced into the tub 12 is quickly brought into contact with clean fracturing fluid to wet the dry proppant and thus form the slurry contained in the tub 12.

By bringing the dry proppant together with the clean fracturing fluid substantially immediately after the two are introduced into the tub 12, the dry proppant will be very rapidly wetted by the clean fracturing fluid. This is contrasted to the result which would occur if an attempt were made to mix the proppant into slurry that already contained a substantial amount of proppant material. In the latter case, it is very difficult to wet the dry proppant, and it is possible to cause proppant to drop out of the slurry at various points within the tub.

The proppant 124 and clean fracturing fluid are introduced into the tub 12 in a proportion such that the slurry in the tub has the desired density or solids-to-fluid ratio. As previously mentioned, the present invention is particularly applicable to the mixing of relatively high density slurries having a solids-to-fluid ratio greater than 10 lbs/gal.

A foraminous baffle means 127 is mounted within the tub 12 for reducing rotational motion of the slurry within the tub 12 about the axis 76 of shaft 78. The baffle means 127 includes upper baffle means 129 located at an elevation above the upper agitator means 80 and a lower baffle means 131 located at an elevation between the upper and lower agitator means 80 and 82.

Each of the upper and lower baffles means 129 and 131 includes a plurality of angularly spaced baffles extending radially inwardly toward the shaft 78. Two baffles 133 and 135 of upper baffle means 129 are shown. Similarly, two baffles 137 and 139 of lower baffle means 131 are shown.

Each of the baffles such as baffle 135 is preferably constructed from an expanded metal sheet 141 bolted to a pair of vertically spaced radially extending angle shaped support members 143 and 145. In the embodiment illustrated in FIG. 3, there are preferably four baffles making up the upper baffle means 129 and similarly four baffles making up the lower baffle means 131. The four baffles of each baffle means are preferably located at angles of 90° to each other about the axis 76 of shaft 78.

The baffle means constructed from the expanded metal sheets can be further characterized as having a baffle area, that is the overall area of the sheet, with a relatively large plurality of relatively uniformly distributed openings defined therethrough, said openings occupying substantially greater than one-half of the baffle area. Such a baffle provides means for reducing the rotational motion of the slurry about axis 76 while avoiding substantial dropout of the proppant material from the slurry. If solid baffles were utilized, the proppant material would drop from the slurry to the bottom of the tub 12 until it piled up to the point where the agitator 14 could no longer operate and the system would shut down.

The pump 20, as previously mentioned, is preferably of the type known as a double suction vertical sump pump. The pump 20 has a centrifugal impeller, the location of which is schematically shown in dashed lines and indicated by the numeral 128 in FIG. 2. The impeller 128 rotates about a generally vertical axis 130 within a pump housing 132 having the upper and lower suction inlets 22 and 24 defined in the housing 132 on axially opposite sides of the impeller 128.

The standpipe 28 includes a generally vertical tubular portion 134 and a generally horizontal tubular portion 136. A lower end 138 of vertical portion 134 of standpipe 28 is connected to the upper suction inlet 22 of pump 20. A fluid inlet 140 defined in the laterally outer end of horizontal portion 136 of standpipe 28 is connected to and communicated with the upper fluid outlet 26 of tub 12. Thus, fluid, i.e., slurry, contained within the tub 12 communicates through the upper fluid outlet 26 with the standpipe 28 so that this fluid can fill the tub 12 and the standpipe 28 to substantially equal elevations. The vertical portion 134 of standpipe 28 has a generally open upper end 142 which as shown in FIG. 2 is at an elevation just shortly below the open upper end 74 of tub 12. Upper end 142 extends above the upper surface 110 (see FIG. 4) of the slurry in tub 12.

The pump 20 includes a drive means 144 mounted upon the support structure 66 above the open upper end 142 of standpipe 28. Pump 20 also includes a vertical pump drive shaft 146 extending downward from the pump drive means 144 through the vertical portion 134 of standpipe 28 to the impeller 128.

In order to assure the maximum residence time for the slurry as it moves through the mixing tub 12, it is desirable that the slurry be primarily drawn through the lower fluid outlet 30 rather than the upper fluid outlet 26. Preferably about 90% of the slurry is drawn through the lower fluid outlet 30. This is accomplished in two ways. First, an orifice plate 148 is sandwiched between the connection of upper fluid outlet 26 with the fluid inlet 140 of standpipe 28 to reduce the area available for fluid flow therethrough. More significantly, a position of the impeller 128 within the housing 132 of pump 20 is adjusted so that the pump 20 pulls substantially more fluid through its lower suction inlet 24 then through its upper suction inlet 34. This insures that a lower slurry flow rate through the lower suction inlet 24 is substantially greater than an upper slurry flow rate through the upper suction inlet 22. The adjustability of the impeller 128 within the housing 132 is an inherent characteristic of the double suction vertical sump pump 20 as it is available from existing manufacturers.

It is important, however, that a minority portion of the slurry be pumped out of the tub 12 through the upper slurry outlet 26 and the standpipe 28 leading to the upper suction inlet 22 of pump 20. This prevents the pump 20 from pulling air in through its upper suction inlet 22.

The lower suction conduit 32, as seen in FIG. 2, has connected thereto a sampler valve 150 which preferably is a butterfly valve which allows samples of the slurry to be discharged through a sample outlet 152.

The mixing of high density fracturing slurries typically entrains in the slurry a significant amount of air which is carried in with the dry proppant material 124. One significant advantage of using a vertical sump pump to pump such a slurry from the tub 12, is that the vertical orientation of the axis 130 of rotation of the impeller 128 permits the air contained within the slurry to migrate toward the eye of the impeller 128 and then escape simply by the effect of gravity upward through the fluid contained in the standpipe 28. This aids significantly in the removal of entrained air from the slurry as it is pumped out of the tub 12.

There are a number of other practical advantages to the use of the vertical sump pump 20. As mentioned, the design of the pump aids in the removal of entrained air from the slurry, and thus the vertical sump pump 20 is not prone to air locking. Also, the vertical sump pump 20 does not have any seals around its drive shaft 146 to leak or wear out. Another advantage of the sump pump 20, is that it can be obtained with a rubber lined housing and rubber coated impeller which is very good for resisting abrasion which is otherwise caused by the solids materials contained in the slurry. Also, using the vertical sump pump 20 rather than a more traditional horizontal centrifugal pump allows the suction inlet 24 to be placed much lower relative to the tub 12 than could typically be accomplished with the traditional horizontal centrifugal pump. This makes the vertical sump pump 20 very easy to prime as compared to a more traditional horizontally oriented pump.

As shown in the following examples, Applicants have constructed apparatus in accordance with the present invention, and testing on the same shows that it is very effective for the mixing of very high density fracturing fluids.

EXAMPLE 1

Figure 6:
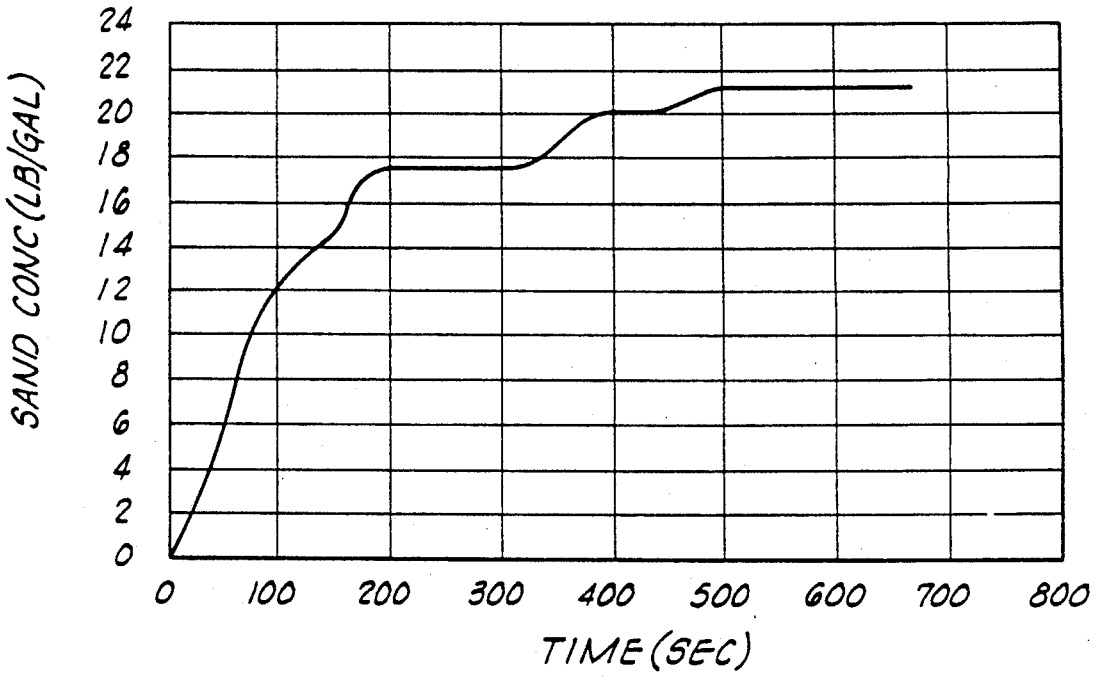
FIG. 6 is a graphic illustration of sand concentration versus time for Example 1.

A bench scale mixing tank approximately half scale was built to determine initial design criteria. All bench scale tests were done using 20/40 mesh sand and fracturing fluid containing 40 lbs hydroxypropylguar (HPG)/1,000 gals water. The mixing tank and agitator system were constructed generally as shown above in FIG. 3. The pump was an eight-inch vertical sump pump, Model 471872 manufactured by Galigher Ash located in Salt Lake City, Utah. FIG. 6 is a plot of sand concentration versus time. This plot is an example of the type of data collected with the bench scale system. It is at a flow rate of 5 bbl/min and shows that a sand concentration of approximately 21 lbs/gal was achieved for over three minutes.

EXAMPLE 2

After the bench scale test, a full-size mixing system was concentrated, again generally in accordance with the structure shown in FIGS. 2, 3 and 5. The pump was an eight-inch vertical sump pump Model 471872 manufactured by Galigher Ash located in Salt Lake City, Utah. In this larger mixing system, geometric similarity was used to scale up to geometric parts. Various length within the system were scaled up by a fixed ratio. The agitator speed was then adjusted on the large scale system to achieve the desired process result. An automatic agitator speed control system was incorporated. The control system increases the agitator speed as the sand concentration increases and as the throughout flow rate increases in an attempt to keep the process result the same. The sand input rate into the tub 12 increases with the throughout rate or sand concentration. As the amount of sand to be wetted increases, intensity of agitation must also increase to complete the sand wetting process and achieve a constant process result. As the intensity of agitation increases, the input power required will increase. Increasing effective viscosity in the tub 12, as sand concentration increases, also adds difficulty to the mixing task. As the effective viscosity increases, the intensity of agitation must also increase to keep the mixing process turbulent.

The volume of the tub 12 constructed for Example 2 is constrained by its installation on mobile equipment, and the volume was chosen to be as large as possible to accommodate a mixing tank whose diameter was approximately equal to its fluid depth and still fit within the constraint of the mobile equipment. The mixing tank design volume used in this work was 9 barrels. Residence time in this tank at this volume and design flow rates range from 60 seconds at nine barrels per minute to 7.2 seconds at 75 barrels per minute. The time available to perform a mixing task has a considerable effect on mixer power requirements. As mixing time decreases, the input power required will increase for a constant process result. This mixing task is further complicated because most fracturing sand slurries are high viscosity, non-Newtonian and shear sensitive.

Figure 7:
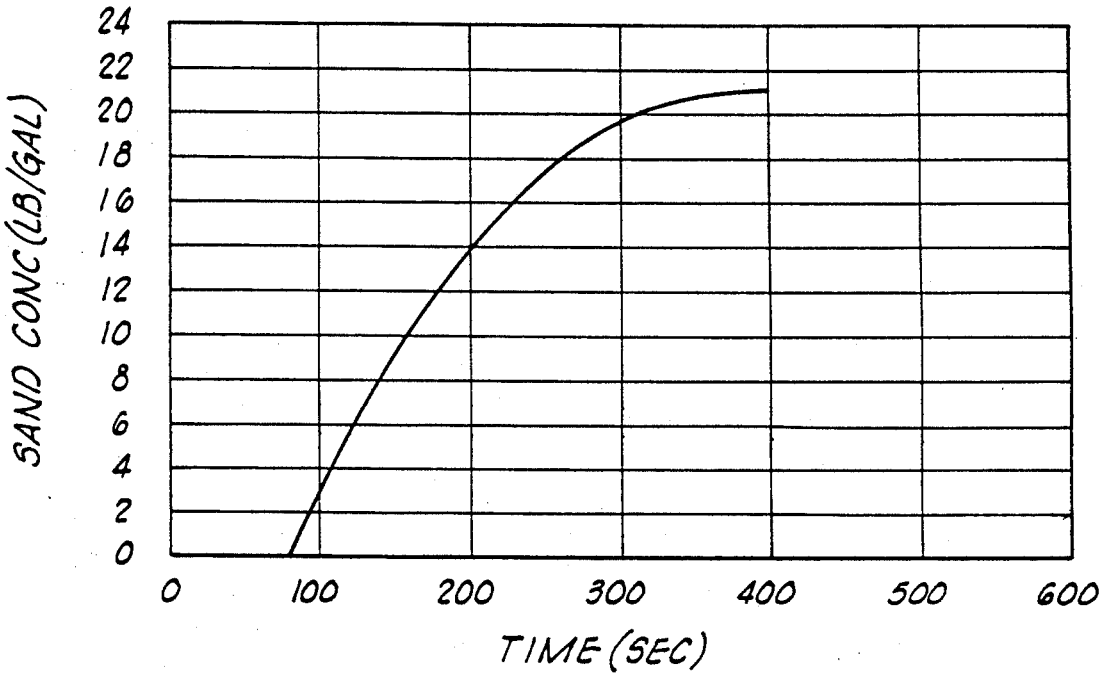
FIGS. 7-11 are each graphic illustrations of sand concentration versus time for various tests described in Example 2.
Figure 9:
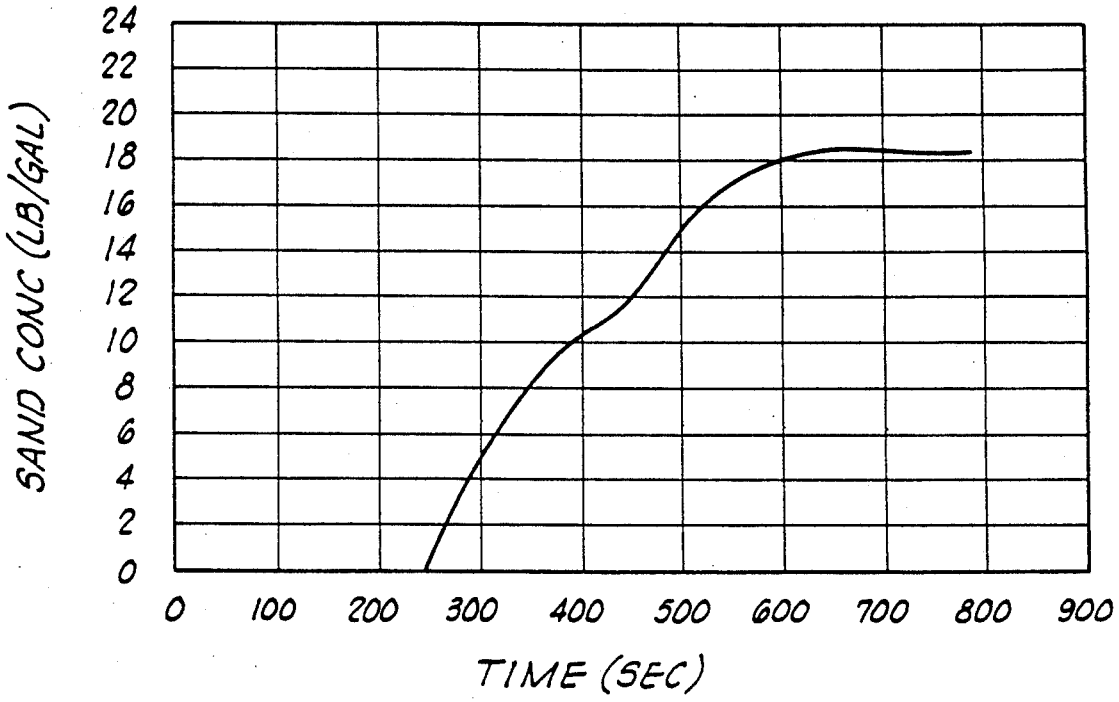
Figure 10:
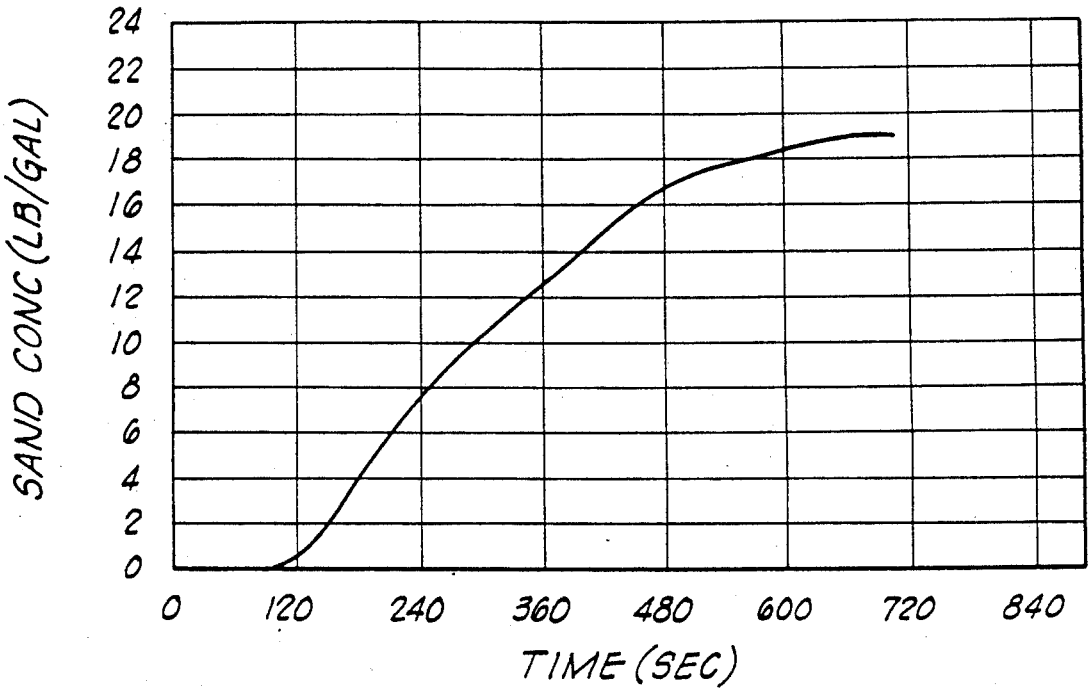
Figure 11:
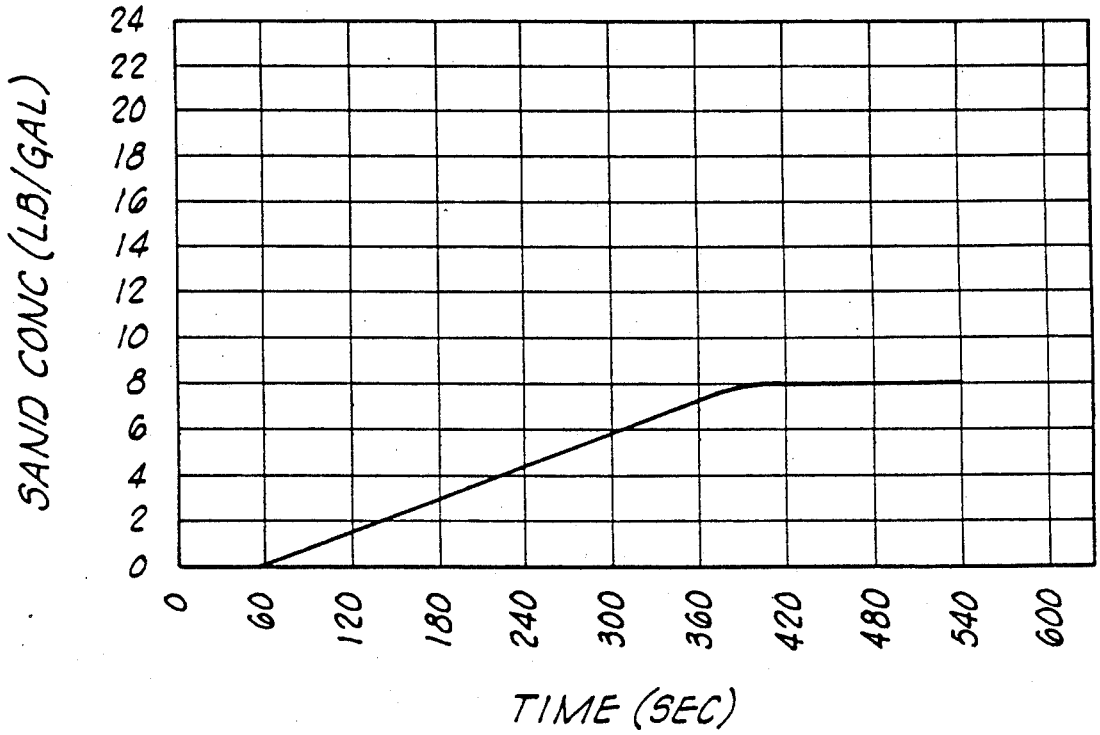

Data collected during full-scale testing are shown in FIGS. 7–11. All full-scale testing used 20/40 mesh sand and fracturing fluid containing 40 lbs HPG/1,000 gals. These figures show sand concentration versus time. FIG. 7 shows that a sand concentration of 21 lbs/gal. was achieved at a flow rate of 10 bbl/min. FIG. 8 shows a stepped increase in sand concentration up to 18 lbs/gal. FIG. 9 shows a continuous increase in sand concentration up to 18 lbs/gal then holding 18 lbs/gal for 1½ minutes. FIG. 10 shows a continuous run to a sand concentration of 19 lbs/gal. FIG. 11 is for a test at a slurry rate of 50 bbl/min. and sand concentration ramped up to 8 lbs/gal. These tests show that the mixing system is reliable for mixing fracturing sand slurries up to sand concentrations of 22 lbs/gal, at flow rates ranging up to 75 bbl/min.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts may be made which changes are encompassed within the scope and spirit of the present invention as defined by the appended claims.

What is claimed is:

1. A mixing apparatus, comprising:

a mixing tub having upper and lower fluid outlets defined therein;

a pump having a centrifugal impeller rotating about a generally vertical axis within a pump housing and having upper and lower suction inlets defined in said housing on axially opposite sides of said impeller;

a lower suction conduit connecting said lower fluid outlet of said tub with said lower suction inlet of said pump; and a standpipe having a lower end connected to said upper suction inlet of said pump and having a fluid inlet communicated with said upper fluid outlet of said tub so that fluids can fill said tub and said standpipe to substantially equal elevations.

2. The apparatus of claim 1, wherein:

said pump includes a drive means located above said standpipe, and includes a vertical drive shaft extending downward from said drive means through said standpipe to said impeller.

3. The apparatus of claim 1, being further characterized as an apparatus for mixing a slurry including solid material in a carrier fluid, wherein:

said pump is further characterized as a means for eliminating entrained air from said slurry by permitting said entrained air to escape upward through said standpipe.

4. The apparatus of claim 1, wherein:

said pump is further characterized that a position of said impeller within said housing is adjusted so that a lower slurry flow rate through said lower suction inlet is substantially greater than an upper slurry flow rate through said upper suction inlet.

* * * * *